United States Patent [19]

Clark et al.

[11] 4,220,384

[45] Sep. 2, 1980

[54] LOOSE PIECE TERMINAL MOUNTING ASSEMBLY

[75] Inventors: Richard P. Clark, Camp Hill; Gary L. Zimmerman, Shermans Dale, both of Pa.

[73] Assignee: AMP Incorporated, Harrisburg, Pa.

[21] Appl. No.: 953,294

[22] Filed: Oct. 20, 1978

[51] Int. Cl.[3] ..... H01R 13/48

[52] U.S. Cl. ..... 339/59 M; 29/842; 206/329

[58] Field of Search ..... 339/59 R, 59 M, 61 R, 339/61 M, 198 R; 29/626, 739; 206/329

[56] References Cited

U.S. PATENT DOCUMENTS

| | | | |
|---|---|---|---|
| Re. 26,646 | 8/1969 | Evans | 29/190 |
| Re. 26,837 | 3/1970 | Evans | 29/190 |
| 2,823,789 | 2/1958 | Henning | 198/131 |
| 2,839,188 | 6/1958 | Cipriani et al. | 206/79 |
| 2,931,006 | 3/1960 | Klumpp, Jr. | 339/198 |
| 2,964,171 | 12/1960 | Chadwick | 206/56 |
| 3,048,268 | 8/1962 | Rocchi et al. | 206/65 |
| 3,263,205 | 7/1966 | Chandler | 339/198 |
| 3,500,288 | 3/1970 | Startin et al. | 339/17 |
| 3,841,472 | 10/1974 | Fuller et al. | 206/329 |
| 4,061,405 | 12/1977 | Minter | 206/329 |

FOREIGN PATENT DOCUMENTS

| | | | |
|---|---|---|---|
| 737110 | 6/1966 | Canada . | |
| 1218577 | 6/1966 | Fed. Rep. of Germany | 339/198 R |

*Primary Examiner*—Joseph H. McGlynn
*Attorney, Agent, or Firm*—Russell J. Egan

[57] ABSTRACT

A carrier housing is disclosed having a plurality of parallel spaced receptacles, each receptacle adapted to receive a loose piece electrical terminal therein. The housing serves several functions, first, to hold the terminals for mass handling and/or insertion of loose piece terminals, second, as a means to assure correct alignment of the loose piece terminals, and third, as a housing to at least partially support and insulate the terminals after the terminals have been inserted into a printed circuit board or the like. The carrier housing can be formed in either continuous or discrete length.

6 Claims, 4 Drawing Figures

Fig. 3
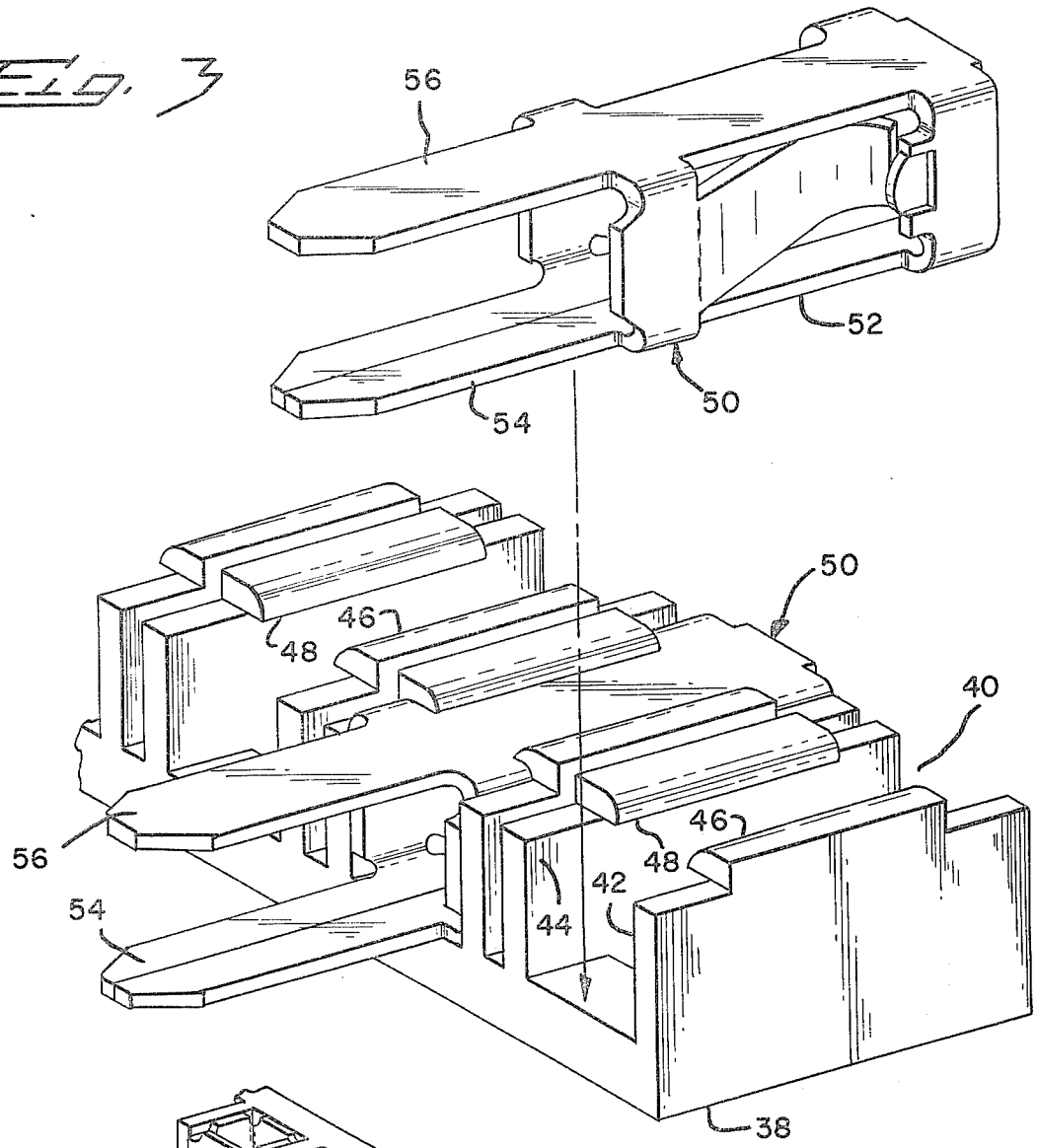
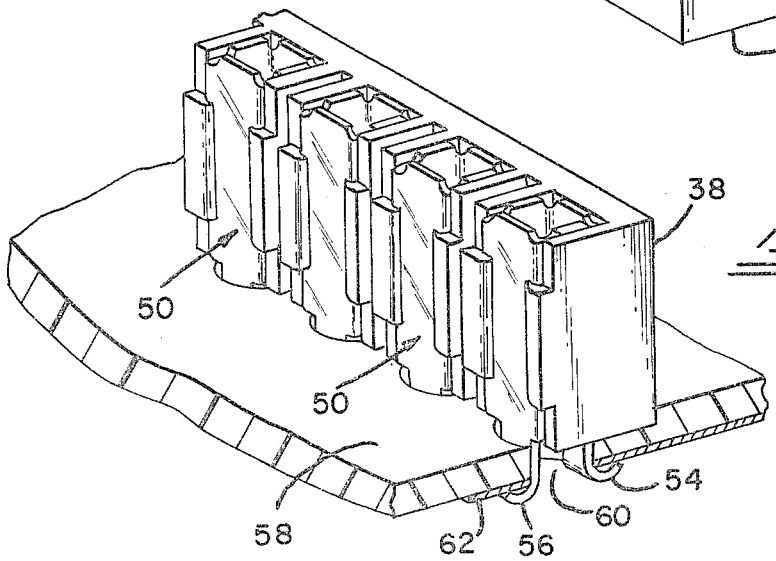
Fig. 4

LOOSE PIECE TERMINAL MOUNTING ASSEMBLY

BACKGROUND OF THE INVENTION

1. The Field of the Invention

The present invention relates to a carrier housing and in particular a carrier housing accepting therein a plurality of loose piece terminals which can be subsequently processed by a mass insertion technique.

2. The Prior Art

Heretofore the user of small quantities of electrical terminals did not have mass insertion techniques and equipment available to him because of volume requirements. He had to rely upon individual insertion of loose piece terminals. Thus, the advantages and economy of mass insertion were not available to him. He also had all the problems associated with loose piece terminals, namely difficulty in handling, orientation when mounting, and protecting when mounted.

SUMMARY OF THE INVENTION

The present invention overcomes the above noted disadvantages by providing a carrier housing having a plurality of terminal receiving cavities formed therein in parallel spaced relationship. Each cavity is formed by a pair of spaced profiled walls. The walls of adjacent cavities are spaced so that the carrier can be flexed without relaxing the gripping of a terminal received in any one cavity. One end of each cavity can be profiled to form an entry to the terminal located in the cavity.

The subject carrier housing is loaded with preformed loose piece terminals with connecting legs of the terminals extending from the housing. The loaded carrier housing is then mounted on a printed circuit board, or the like, with the legs of the terminal being mass inserted into the board and connected thereto by conventional soldering techniques.

It is therefor an object of the present invention to produce a loose piece terminal carrier housing which serves both to hold the terminals in an aligned condition for insertion and as an insulated housing for the terminals in their final assembly.

It is another object of the present invention to produce a terminal carrier housing which serves to hold loose terminals in position during handling regardless of any bending and flexing which the carrier housing may undergo.

It is a further object of the present invention to produce a terminal carrier housing which includes an entry for feeding mating terminals into those carried in the carrier housing.

It is a still further object of the present invention to produce a loose piece terminal carrier housing which can be readily and economically produced.

The means for accomplishing these and other objects and advantages of the present invention will become apparent to those skilled in the art from the following detailed description taken with reference to the accompanying drawings.

BRIEF DESCRIPTION OF THE DRAWINGS

FIG. 3 is a perspective view of one end of an alternate embodiment of the subject carrier housing with a single loose piece terminal exploded therefrom; and FIG. 4 is a perspective view of the alternate embodiment of FIG. 3 in a fully assembled condition.

DETAILED DESCRIPTION OF THE EMBODIMENTS

Figure 1:
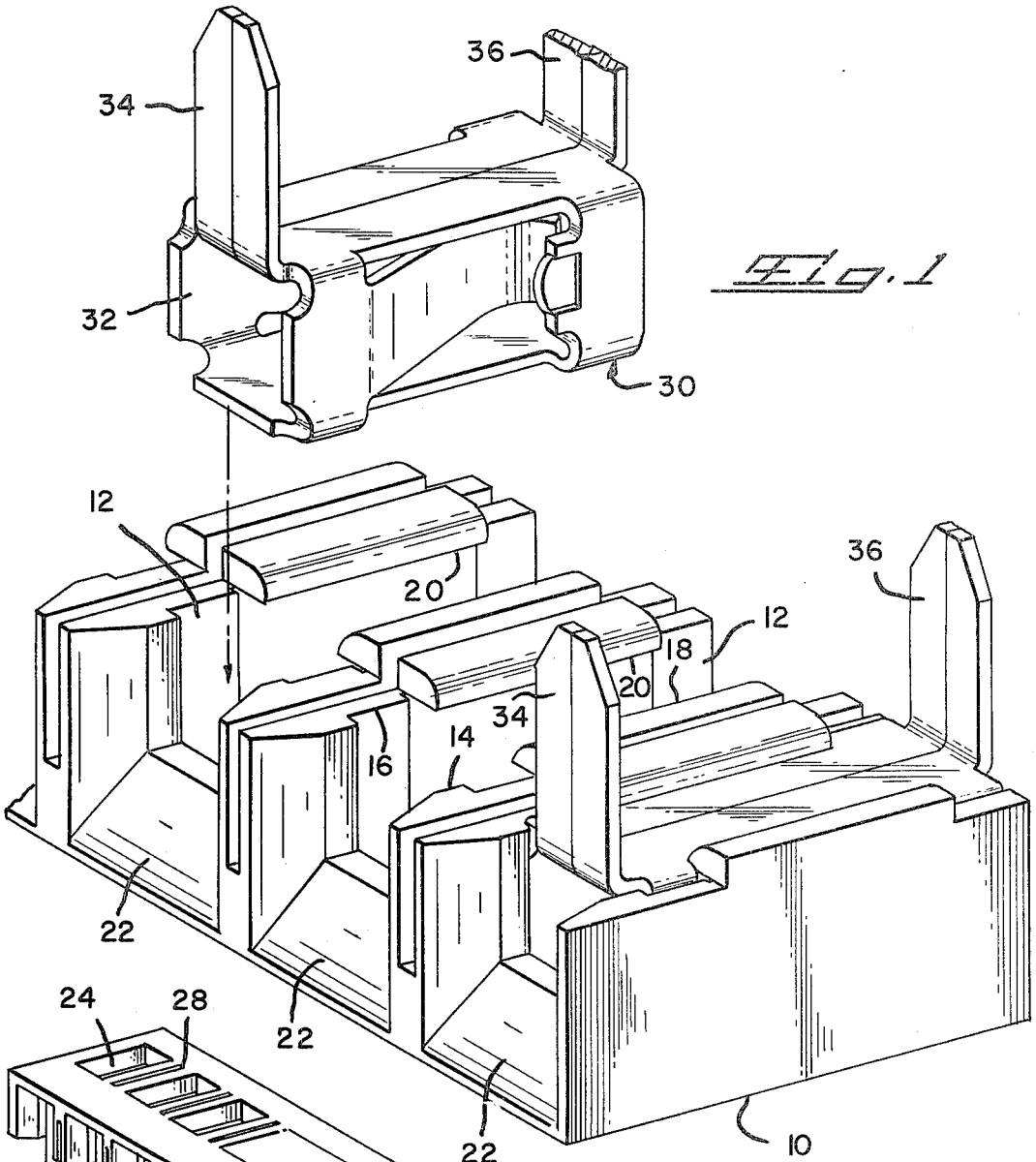
FIG. 1 is a perspective view of one end of the subject carrier housing with a single loose piece terminal exploded therefrom.
Figure 2:
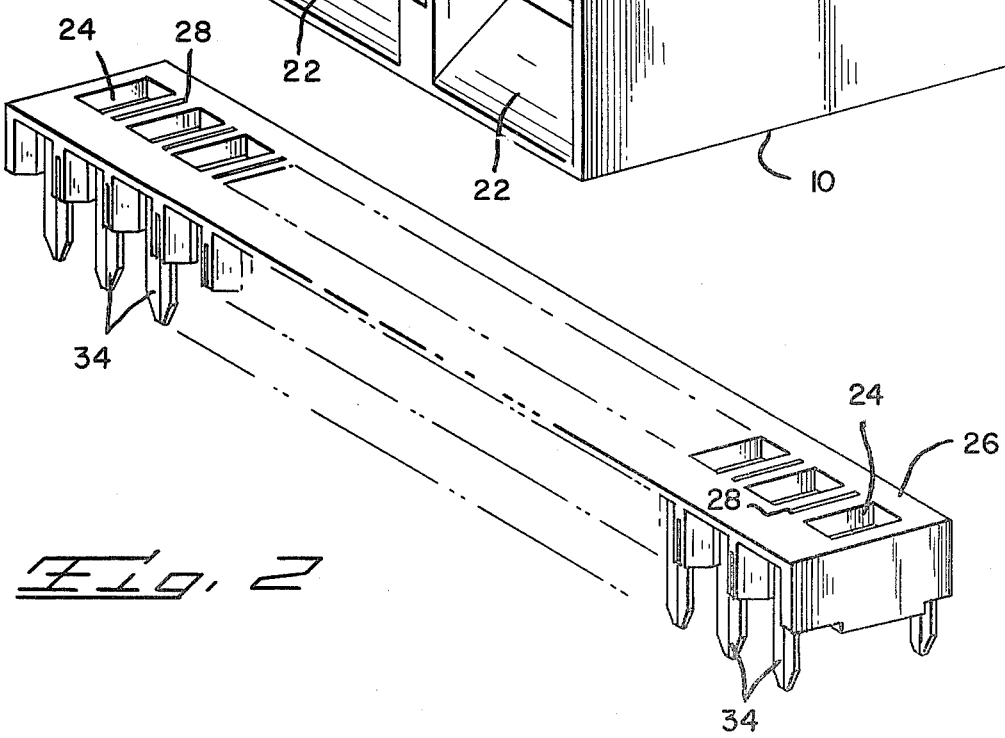
FIG. 2 is a perspective view of the opposite side of the carrier housing of FIG. 1.

One end of the subject carrier housing 10 is shown in FIG. 1. The housing 10 has a plurality of parallel, spaced, terminal receiving cavities 12 formed along one longitudinal side. The cavities 12 are each defined by a pair of parallel, spaced, profiled sidewalls 14, 16. Each sidewall has an inwardly directed lip 18, 20, respectively, on its upper free edge. The housing 10 has a plurality of profiled entryways 22 each leading to a respective cavity 12. There is also an aperture 24 in the base 26 of the housing leading to each cavity and a further aperture 28 extending between adjacent walls of the adjacent pairs of sidewalls.

A terminal 30 having a receptacle portion 32 and mounting tabs 34, 36 is mounted in each cavity 12 with the tabs extending from the carrier housing. The terminal illustrated is merely illustrative of the type of terminal which can be employed in this embodiment of the invention. The illustrated terminal is fully disclosed in U.S. Pat. Re. Nos. 26,646 and 26,837 the disclosures of which are incorporated herein by reference.

Normally the individual terminals would be loaded into a carrier housing manufactured to the desired length or cut to length from a continuous molded strip. The sized and loaded carrier housing 10 would hold the terminals 30 in an aligned and properly oriented position for insertion into a printed circuit board or the like, the tabs 34, 36 of the terminal 30 being received in appropriate apertures of the board (not shown). The assembly would then be processed by a known wave soldering technique or other suitable means to electrically and mechanically secure the terminals to the circuit board. The assembly and soldering steps clearly can be manual, semi-automatic or fully automatic without affecting the present invention. It will be appreciated that the carrier housing will function as a conventional housing in the final assembly to protect and isolate the terminals while facilitating mating with the terminals.

An alternate embodiment of the subject carrier housing 38 is shown in FIGS. 3 and 4. This embodiment differs from the above discussed embodiment in that there are no individual entryways leading to the terminal cavities. The housing 38 has a plurality of cavities 40 formed by spaced sidewalls 42, 44 having inwardly directed lips 46, 48 at the upper edges thereof. The terminals 50 are similar to the previously discussed terminals 30 with a receptacle body 52 having tabs 54, 56 extending from one end thereof. When the terminals 50 are loaded in the housing, the tabs 54, 56 extend from one edge thereof for vertical mounting, as shown in FIG. 4. The terminals are properly oriented by this embodiment of the carrier housing just as with the previously discussed embodiment. The tabs are passed through apertures 60, bent, and soldered to circuitry 62 of the circuit board 58.

The present invention may be subject to many modifications and changes without departing from the spirit or essential characteristics thereof. The present embodiments should therefor be considered in all respects as illustrative and not restrictive of the scope of the invention.

What is claimed is:

1. A carrier housing for loose piece electrical terminals, said carrier housing comprising:

an elongated unitary member of insulative material having an elongated base portion and a plurality of pairs of spaced profiled sidewalls extending substantially normal to and transversely across the width of said base portion, each said pair of sidewall defining therebetween an elongated terminal receiving cavity, each said pair of sidewalls including an inwardly directed lip at the free edge of each sidewall for retaining a terminal in said cavity, the adjacent sidewalls of adjacent pairs of sidewalls being spaced apart whereby said carrier housing can be bent and flexed without reducing the gripping forces applied to each terminal carried thereby.

2. A carrier housing according to claim 1 wherein one end of each pair of sidewalls and the intermediate base portion form a tapered entryway leading to the respective cavity.

3. A carrier housing according to claim 1 wherein each said cavity serves to properly orient the terminal received therein.

4. A means for handling loose piece electrical terminals for mass insertion comprising:

an elongated unitary member of insulative material having a base portion and a plurality of pairs of spaced profiled sidewalls extending normal to and transversely across at least one elongated surface of said base portion, each said pair of sidewall defining therebetween a profiled elongated terminal receiving cavity, each said pair of sidewalls including an inwardly directed lip on the upper free edge of each sidewall adapted to retain a terminal in said cavity, the adjacent sidewalls of adjacent pairs of sidewalls being spaced apart whereby said member can be bent and flexed without reducing the grip on any terminal carried thereby.

5. A means according to claim 4 wherein one end of each pair of sidewalls and the intermediate base portion form a tapered entryway leading to the respective cavity.

6. A means according to claim 4 wherein said profiled terminal receiving cavity serves to properly orient the respective terminal for insertion.

* * * * *